United States Patent [19]

Rieunier et al.

[11] Patent Number: 4,911,789

[45] Date of Patent: Mar. 27, 1990

[54] GLASS FIBRE-BASED PAPER

[75] Inventors: Jean-Baptiste Rieunier, Nogent sur Oise; Marcel Fontar, Liancourt; Patrick B. Le Breton, Rantigny, all of France

[73] Assignee: Orgel, Courbevoie, France

[21] Appl. No.: 109,327

[22] Filed: Oct. 19, 1987

[30] Foreign Application Priority Data

Oct. 17, 1986 [FR] France ..... 86 14430

[51] Int. Cl.[4] ..... D21H 5/18

[52] U.S. Cl. ..... 162/156; 55/524; 55/527; 162/158; 162/161; 162/164.3; 162/168.1; 429/247; 429/252

[58] Field of Search ..... 162/145, 156, 158, 168.1, 162/164.3; 65/4.4, 9, 6; 55/524, 527; 429/247, 252

[56] References Cited

U.S. PATENT DOCUMENTS 3,085,126 4/1963 Labino ..... 162/156
3,758,375 9/1973 Keib et al. ..... 162/156
3,838,995 10/1974 Smith ..... 162/156
4,286,977 1/1981 Klein .

FOREIGN PATENT DOCUMENTS 565088 7/1977 U.S.S.R. ..... 162/156

OTHER PUBLICATIONS

"Fiberglass Products for Papermaking", Owens—Corning Brochure, (Feb. 1954), pp. 5–16.

*Primary Examiner*—Peter Chin
*Attorney, Agent, or Firm*—Oblon, Spivak, McClelland, Maier & Neustadt

[57] ABSTRACT

The invention relates to a glass microfibre based paper, the said fibres being obtained by centrifugal processing of molten glass which is drawn by an annular gas flow at elevated temperature and velocity, which passes along the peripheral wall of the centrifuge. The centrifuge rotates at a peripheral velocity of between 50 and 20 m/sec. and the quantity of glass drawn is less than 6 tons per day and per meter of centrifuge periphery in the case of microfibres of 2 to 3 microns and less than 1 ton per day and per meter of centrifuge periphery in the case of microfibres of less than 1 micron.

9 Claims, No Drawings

GLASS FIBRE-BASED PAPER

BACKGROUND OF THE INVENTION

1. Field of the Invention

The invention relates to papers which are essentially constituted of glass fibres having a mean diameter less than 3 microns, used particularly for the production of high-performance aerosol fitters and separators for use in batteries.

2. Background of the Prior Art

The generic term "glass fibre" denotes quite a range of products having widely diverse characteristics, particular among which are the fibre drawing technique employed and the average diameter of the fibres produced. What are known as "textile" fibres, obtained by continuous mechanical drawing of glass filaments produced through a die, have a mean diameter generally between 5 and 15 microns, to consider only the unitary filaments. So-called "insulating" fibres, obtained by centrifugal processes which use gas flows for the drawing process, have a mean diameter ranging from 5 to 6 microns for standard insulating products to less than 1 micron for the most sophisticated applications. Generally, we will use the term "microfibres" to designate glass fibres obtained by this latter process and the mean diameter of which is less than 3 microns.

Over and above this exceptional fineness, microfibres likewise have the qualities expected of all glass fibres, which are a very high chemical inertia, ease of use and relatively modest production costs, particularly in comparison with other mineral fibres. All these qualities make microfibres quite an attractive proposition. One outlet which is more particularly envisaged by the present invention is the manufacture of microfibre based papers which are intended, for instance, for aerosol filters, particularly for clean rooms or for use as separators of battery elements.

Such papers are made in accordance with conventional paper making techniques. For a so-called absolute aerosol filter, a typical composition comprises, for example, apart from the microfibres, approx. 5% of cut textile fibres, an acrylic binder, possibly a fungicide and a waterproofing agent. The improvements to this art have hitherto related to the nature and the respective quantities of the various additives and the mean diameter of the microfibres, in other words the weight ratio of microfibres of 2 to 3 microns and microfibres of 1 micron or less. U.S. Pat. No. 4,286,977 provides an example of improvements which can be achieved. Similar compositions are used for separators of battery elements.

For these latter, it is particularly favourable for the microfibre based paper to have the highest possible retention capacity and a high capillary ascension. Furthermore, whatever may be the envisaged use of the paper, good compressibility and high bulk are very advantageous. The inventors have observed that, with this end in mind, it was worthwhile having available a lower density paper of constant basic substance.

SUMMARY OF THE INVENTION

In accordance with embodiment, the paper according to the invention is based on glass microfibres of 2 to 3 microns diameter and/or microfibres of less than 1 micron diameter, the said microfibres being produced by centrifugation and drawing, by an annular flow of gas passing over the peripheral wall of a centrifuge at elevated velocity, molten glass filaments escaping outwardly through orifices in the peripheral wall of the centrifuge, the peripheral velocity of which is between 50 and 90 m/sec., the quantity of glass drawn being less than 6 tonnes per day and per metre of centrifuge periphery in the case of microfibres of 2 to 3 microns and less than 1 tonne per day per meter of centrifuge periphery for microfibres of less than 1 micron.

More particularly suitable for the invention are centrifuges of a diameter between 550 and 1100 mm and with a peripheral velocity between 55 and 75 m/sec.

Therefore, for a centrifuge having a diameter equal to 600 mm and with a peripheral velocity of 60 m/sec., the amount of glass drawn is according to the invention preferably less than 11 tonnes per day for microfibres of 2 to 3 microns and less than 1.8 tonnes in the case of microfibres of less than 1 micron.

Preferably, the velocity of the annular drawing gas flow is between 200 and 250 m/sec. for the production of microfibres of 2 to 3 microns (in other words, a dynamic pressure of around 50 to 80 kilopascals), and between 300 and 320 m/sec. for the production of microfibres of less than 1 micron (in other words, a dynamic pressure of around 100 kilopascals), higher pressures not being desirable.

Preferably, various additives are added to the paper according to the invention. In particular, these may be less than 5% textile glass fibres of 6 to 7 mm length and of, for instance, 10 microns mean diameter, an acrylic fibre, a fungicide and a water repellent agent.

DETAILED DESCRIPTION OF THE INVENTION

The production process and apparatus are of the types described in the European publications of Pats. 0 091 381, and 0 091 866. Microfibres having a mean diameter of less than 2 to 3 microns and above all less than 1 micron cannot however be obtained except by maintaining limit conditions especially a drawing gas velocity close to 300 to 320 m/sec. for the finest microfibres, achieved by virtue of a quite substantial increase in the burner pressure and by using a centrifuge with a diameter in excess of 550 mm. Furthermore, in order to maintain very good quality in the fibres in spite of the drawing being performed by very violent gas flows, it is necessary to limit the drawing per centrifuge to approx. 1.8 tonnes per day for these microfibres of less than 1 micron, this latter limitation being entirely acceptable for the production of microfibres, a product which is quite profitable.

When such microfibres are used, a wet process produces a paper which, for identical substance, offers a clearly diminished density which is less than 100 kg/cu.m—for surface masses less than or equal to 100 g/sq.m. This reduction in density is particularly unexpected if it is noted that the microfibres used for papers according to the current art are themselves obtained by aerodynamic fibre drawing processes and therefore have a certain "crinkled" character which contrasts them with what are referred to as "textile" fibres. Without going into technical considerations while still at the hypothetical stage it can be seen therefore that on the paper making line there is a particular organisation of the microfibres selected according to the invention.

This reduced density offers the paper users quite a number of advantages. Filter manufacturers associate it with a reduction in head losses for equal efficiency, in other words the possibility of filtering greater levels of air throughput without adversely affecting the quality of filtration.

The papers according to the invention likewise offer greater capillary ascension as well as increased retention and compressibility. Manufacturers of batteries for accumulators can more particularly profit from these three last-mentioned characteristics. Finally, and this is very advantageous aspect of the papers according to tee invention, they are very easily calendered.

In order more exactly to stipulate the framework of the invention and above all this calendering aspect, it is necessary to refer again to the wet preparation techniques used for this type of microfibre-based paper, techniques which are directly derived from conventional paper making methods—naturally disregarding the problems linked with the preparation or separation of fibres which in this case are not of a vegetable nature.

Vegetable or mineral, the fibres are delivered to the paper mill in bales which have to be broken up in the presence of water in a "pulper", a tank in which there is an agitator which provides quite brisk agitation. Here, the difficulty is to isolate the fibres without excessively damaging their integrity; in practice, the behaviour of fibres in the "pulper" is still largely unexplained, and one can only establish whether fibres are not greatly damaged or are indeed considerably damaged by this vital treatment.

Prepared in this way, the pulp to which various additives such as so-called "textile" fibres, a binder, a fungicide and a water repellent agent may have been added, is conveyed to the paper making machine proper, which substantially comprises a head tank with a distributor adapted to delivery a jet of pulp, the velocity of which is identical over the entire width of the machine, a sheet forming unit composed of at least one continuously revolving web and on which are deposited the fibres which thus form a moist sheet, the water being essentially discharged under the effect of the weight. The wet sheet is finally dried by compressor rollers from which it emerges with its pores saturated. The sheet is finally introduced into the drying zone where it is compressed an/or the final arrangement of the fibres is achieved.

Upon emerging from the drying zone, the sheet of paper still retains a low moisture content and undergoes a final drying stage, for example between two calender rollers heated, for instance, to more than 100° C. The efficiency of this drying stage will be all the better if the calender rollers exert considerable pressure on the paper and therefore if the thickness of the paper prior to calendering is vastly different from the desired thickness which has to be achieved. Papers produced using microfibres according to the invention exhibit an excess thickness due t their low density prior to calendering. Thus, control of their final thickness is markedly facilitated and furthermore the paper emerges in a very dry condition which shows that its pores are available in particular for filtration or for the absorption of electrolytes.

From this very diagrammatic description of the paper producing method, it will already be appreciated that the arrangement of the fibres in an aqueous suspension determines the future characteristics of the paper and that apparently minor variations in the structure of the fibres can have quite important consequences in terms of the end product; however, nothing makes it possible at present to associate such variations in behaviour in suspension in water with any precise characteristics of the microfibres.

In order clearly to establish the advantages of the papers according to the invention, microfibres of 2 to 3 microns and microfibres of less than 1 micron were prepared under the conditions described hereinafter.

It is advantageous to use a relatively soft glass, the composition of which may include boron and/or barium and/or fluorine oxides to improve the flowing properties of the glass. The molten glass, the temperature of which is around 100° C., is passed along the essentially vertical axis of a centrifuge, over a distributor means placed inside the centrifuge and adapted to divide the glass into fairly large streams directed towards the inner peripheral wall of the centrifuge from which they escape through a large number of small-diameter orifices. To produce microfibres suitable for the production of papers according to the invention, the diameter of the centrifuge must preferably be greater than or equal to 550 mm, the peripheral velocity of the centrifuge being between 50 and 90 m/sec. and preferably between 55 and 75 m/sec. The glass filaments which emerge from the centrifuge are then drawn by a high velocity annular glass flow at elevated temperature On this premise, numerous possibilities are afforded by way of improvement in the fineness of the fibres. Firstly, the speed of rotation of the centrifuge may be increased, but doing so will seriously harm the length of the working life of the centrifuge, an apparatus which may assume quite elaborate form and may be made from special alloys based on nickel-chrome materials which resist high temperatures and the corrosive nature of the glass and which are therefore quite expensive.

On the other hand, it is more realistic to improve the drawing process which can be achieved by increasing the pressure of the burners at the origin of the annular drawing gas flow in order to achieve a drawing gas velocity of around 200 to 250 m/sec. for the production of microfibres of 2 to 3 microns and around 300 to 320 m/sec. for the production of microfibres of less than 1 micron, without attaining significantly higher values, and a reference temperature of around 1500° C. at burner level. Finally, it is known that the more the molten glass throughput increases, the more the fineness of the fibres will suffer, and so it is necessary in this case to work with far lower rates of throughput of glass than those which are possible in the production of conventional insulating fibres. Microfibres of constant fineness have been obtained with a centrifuge of 600 mm diameter and with a peripheral velocity of 60 m/sec. for microfibres of 2 to 3 microns diameter, a drawing gas velocity of 200 to 250 m/sec. with a drawing of 11 to 12 tonnes of glass per day, and for microfibres of less than 1 micron diameter, a drawing gas velocity of 300 to 320 m/sec. with a drawing per day of below 1.8 tonnes of glass.

The fineness of the microfibres obtained was determined by the micronaire method. For this, a bunch of microfibres of given mass (3 g) is compressed into a predetermined volume which is then traversed by a gas current at a predetermined pressure, measurement of the throughput of air passing through the sample indicating the permeability to air of the sample and therefore the greater or lesser fineness of the fibres of which it is constituted. The test is quickly performed and makes it possible to refer to a pre-established nomogram, mean diameter of the fibres/micronaire degree.

By way of indication, it should be noted that standard glass fibres for heat insulation purposes, having a mean diameter of 5 to 6 microns and a specific surface area of less than 0.3 sq.m/g have a micronaire degree of 25 to 27 1/mn, while under the same conditions, the micronaire degree is only 4.0 to 4. 1/mn for microfibres according to the invention which have a mean diameter of 2 to 3 microns—then with a specific surface area of 0.5 to 0.7 sq.m/g and 0.4 to 0.5 1/mn for microfibres of less than 1 micron—with in this latter case a specific surface area of 2.5 to 3 sq.m/g.

Papers of different gsm substance were prepared from these microfibres, by the wet paper making process. As references—under identical conditions—microfibre-based papers marketed by Messrs. MANVILLE Corporation, under the trade mark "TEMSTRAM", code references 110 (2 to 3 microns) and 106 (under 1 micron) were prepared also, and likewise by an aerodynamic fibre drawing process, a process known as "aerocor" comprising flame drawing.

Measurements were conducted on laboratory paper sheets prepared by the English bench method in accordance with NF-50-002 Standard, Section II, published in November 1980. For this, an aqueous suspension of pulp of a mass corresponding to the desired surface mass density is poured over a metal gauze and is drained in a vacuum. The sheet is thus formed is laid on a couching blotter and then, by means of actual drying plates of the same size as the metal gauze, a sack is formed comprising a sequence which is repeated several times: dry blotter—couching blotter —test sheet—drying plate. The stack is centered on a press and a first pass is performed under 400 kPa in 20 seconds +/− 15s. The sheets are then left for a day on their drying plate in a treatment room prior to being separated and used for the various tests. A first series of tests, summarised in Table I attached to the present memorandum, made it possible to determine, in respect of the sheets thus prepared, their density and thickness, this latter measurement being carried out in accordance with NF Q 03--16 Standards published in October 1980, that is to say on a plain sheet, by means of a high-precision micrometer and over a specific surface area and at a fixed loading. It was thus observed that for identical composition and gsm—the papers according to the invention exhibit densities which are markedly less than those of the paper according to the prior art (which appear under the reference denomination). The papers A, B C, corresponding to gsm ratings less than or equal to 100 g/sq.m advantageously have densities below 100 kg/cu.m.

This reduced density first of all has a considerable advantage for manufacturers of high performance filters who buy in rolls of paper by weight and who thus save around 15% in the case of papers A, B and C.

Furthermore, with papers according to the invention, it is observed that the filter becomes clogged over a larger portion of its thickness, this portion being only one-third in the case of filters produced using papers according to the prior art. In other words, in the case of the invention, the portion of paper which is effective for filtration is larger and it is possible to filter greater quantities of air.

The last line of Table I corresponds to papers having a surface mass of 160 g/sq.m. In this case, no substantial difference in thickness was recorded between the reference paper and the prior art paper. This fact clearly demonstrates the unforeseeable character of the behaviour of microfibres in suspension in water and during the course of the drying operations. However, paper D must not be excluded from the scope of the invention because it has a retention level which is particularly advantageous when compared with the reference papers.

Another series of tests made it possible to measure four more particularly important characteristics in terms of filter paper or battery separator production: the filtration efficiency, capillary ascension, retention and compressibility. The results of the various measurements are shown in Table II appended to this memorandum.

The filtration efficiency was measured in accordance with the DOP method practised in the United States of America, based on the Tundall effect, by photometry on an aerosol with 0.3 micrometer particles of dioctyl phthalate, monodispersed and at a concentration of 50 to 100 mg/cu.m. The figures shown, expressed as a percentage corresponding to output, that is to say to the ratio of the difference of concentrations in relation to the upstream concentration. This measurement made it possible to verify that the papers according to the invention could offer the same efficacy when substituted for reference papers in order to produce filters.

The other three characteristics measured refer more especially to papers intended for use as separators of accumulator battery elements. In this case, the micropores in the paper serve to retain a sufficient quantity of electrolyte for it to remain in the liquid state and neither leak nor diminish nor increase in volume upon completion of battery charging, when gases ar synthesised. Consequently, this paper must advantageously retain electrolyte quickly, which is tantamount to a need for high capillary ascension, making it possible to increase the rates of travel of battery assembly lines.

This latter has been measured in accordance with NF - Q 03 -065 Standards of October 1981, and after 2 mins., the height (in mm) to which the level of distilled water in which the ends of paper specimens were dipped was determined. The greatest gain (over 10%) was achieved with paper C, the fibre composition of which is: 33% microfibres, of less than 1 micron and 67% microfibres of 2 to 3 microns.

In order to produce fluid-tight batteries, it is most particularly advantageous to produce separators which in addition retain a substantial quantity of electrolyte and which are therefore made from a paper having a high retention capacity. The results noted in Table II were obtained by following the procedure set out in NF - Q 03 068 Standards published in December 1982. The paper specimens are progressively immersed by contact with a surface of water, after which the mass of water absorbed after an immersion time and a draining time is determined. The figures provided correspond to the mass of water absorbed, in g/sq.m, by specimens soaked for 30 seconds after the end of the wetting time and then drained for 1 minute. The papers according to the invention exhibit increased retention levels and can therefore be used even for batteries which are subjected to impact or vibration.

Only under this test did paper D, produced with microfibres according to the invention, show any substantial difference in behaviour in relation to the corresponding prior art paper, while its other characteristics were very similar to the latter.

Once again, it is not possible seriously to explain his phenomenon which might be due to a differing distribution of microfibre diameter at the surface of the microfibres, and therefore to a different structure in the micropores of the paper. This unexplained characteristic once again demonstrates how doomed to failure is any extrapolation which seeks to determine the characteristics of papers on a bass of the known characteristics of the microfibres.

A final measurement of compressibility was then conducted on papers B and C—and the corresponding references—which have a gsm rating of 100. The procedure followed was what proposed under the heading "resumption of form" by French published Pat. No. 2 403 651 of YUASA BATTERY COMPANY LIMITED. The percentages indicated in Table II correspond to the ratio of the paper thickness measured after one minute's application of a load of 20 kg/sq.dm to the initial thickness under a load of only 5 kg/sq.dm. The papers according to the invention have a quite considerable compressibility which is always in excess of 95% which greatly facilitates their use; indeed, they can be greatly compressed in order to be positioned between electrodes and the subsequent resumption of thickness ensures a perfect contact between the electrolyte supporting separator and the said electrodes.

Thus, therefore, the papers according to the invention are quite particularly suitable for the two major applications for which the microfibre-based papers have been developed, high performance air filters and accumulator battery separator elements. However, they must not be limited to the aforesaid applications and are likewise quite advantageous in the case of impregnation by liquid non-aqueous substrates, particularly such as epoxy resins used, for instance, in backings for printed circuits.

Obviously, numerous modifications and variations of the present invention are possible in light of the above teachings. It is therefore to be understood that within the scope of the appended claims, the invention may be practiced otherwise than as specifically described herein.

TABLE I

| | Composition (2-3 micron microfibres/ 1 micron microfibres) | Surface mass (g/sq.m) | Density | Thickness (mm) |
|---|---|---|---|---|
| Ref. (Prior | 50-50 | 75 | 115 | 0.65 |
| Art) A | 50-50 | 75 | 99 | 0.76 |
| Ref. (Prior | 50-50 | 100 | 109 | 0.92 |
| Art) B | 50-50 | 100 | 95 | 1.05 |
| Ref. (Prior | 67-33 | 100 | 103 | 0.97 |
| Art) C | 67-33 | 100 | 85 | 1.17 |
| Ref. (Prior | 50-50 | 160 | 155 | 1.03 |
| Art) D | 50-50 | 160 | 155 | 1.04 |

TABLE II

| | Filtration efficiency & | Capillary ascension | Retention | Compressibility |
|---|---|---|---|---|
| Ref. (Prior Art) | 0.02-0.04 | 57 | 1450 | |
| A | 0.02-0.04 | 62 | 1840 | |
| Ref. (Prior Art) | 0.005-0.015 | 59 | 1150 | 94% |
| B | 0.005-0.015 | 62 | 1380 | 95.4% |
| Ref. (Prior Art) | 0.4-0.6 | 64 | 1260 | 95.6% |
| C | 0.4-0.6 | 73 | 1370 | 96.8% |
| Ref. (Prior Art) | ?-0.005 (x) | 67 | 200 | |
| D | ?-0.005 (x) | 66 | 2500 | |

(x) The bottom limit is not measurable

What is claimed as new and desired to be secured by Letters Patent of the United States is:

1. Glass microfiber-based paper made from a microfiber pulp, comprising crinkled glass microfibers selected from the group consisting of microfibers of 2 to 3 microns diameter, microfibers of less than 1 micron diameter and mixtures thereof, wherein the said microfibers are glass fibers produced by means of an annular gas flow drawing process performed at elevated velocity and temperature, the flow passing over the peripheral wall of a centrifuge, molten glass filaments escaping to the outside through orifices in the peripheral wall of the centrifuge and the peripheral velocity of which is between 50 and 90 m/sec., the amount of glass drawn being, for 2 to 3 micron microfibers, less than 6 tons per day and per meter for centrifuge periphery and for microfibers of less than 1 micron, less than 1 ton per day and per meter of centrifuge periphery, the velocity of said annular gas flow being 200 to 250 m/sec., in the case of 2 to 3 micron microfibers and 300 to 320 m/sec., for microfibers of less than 1 microns, said paper having a surface mass less than or equal to 100 g/sq.m., and a density of less than 100 kg/cu.m.

2. Paper according to claim 1, wherein the diameter of the centrifuge is 600 mm and its peripheral speed is 60 m/sec.

3. Paper according to claim 1, wherein it further comprises at most 5% textile glass fibres of 6 to 7 mm length and 10 microns mean diameter.

4. Paper according to claim 1, wherein it comprises an acrylic binder.

5. Paper according to claim 1, wherein it comprises a fungicide and a waterproofing agent.

6. A higher performance aerosol filter comprises of the paper of claim 1.

7. A battery separator element comprising the paper of claim 1.

8. A composite paper impregnated with a non-aqueous liquid substrate comprising the paper of claim 1.

9. The paper of claim 8, wherein said liquid is an epoxy resin.

* * * * *